US008919612B2

(12) United States Patent
Govers

(10) Patent No.: US 8,919,612 B2
(45) Date of Patent: Dec. 30, 2014

(54) DISPERSION ASSEMBLY

(71) Applicant: Mark Charles Govers, Portland, OR (US)

(72) Inventor: Mark Charles Govers, Portland, OR (US)

( * ) Notice: Subject to any disclaimer, the term of this patent is extended or adjusted under 35 U.S.C. 154(b) by 9 days.

(21) Appl. No.: 13/743,332

(22) Filed: Jan. 17, 2013

(65) Prior Publication Data

US 2014/0197248 A1 Jul. 17, 2014

(51) Int. Cl.
*B67D 1/07* (2006.01)
*B05B 15/00* (2006.01)

(52) U.S. Cl.
CPC ..... *B05B 15/00* (2013.01)
USPC ..... 222/192; 222/464.1; 222/159; 222/320

(58) Field of Classification Search
CPC ..... B05B 15/005–15/007; A45D 2034/007; B44C 5/00
USPC ..... 222/192, 464.1–464.7, 382, 459, 159; 239/17, 33; 40/406
See application file for complete search history.

(56) References Cited

U.S. PATENT DOCUMENTS

| | | | | | |
|---|---|---|---|---|---|
| 1,916,646 | A * | 7/1933 | Tycko | 239/33 |
| 3,580,430 | A * | 5/1971 | Angele | 222/394 |
| D243,817 | S * | 3/1977 | Cloyd | D7/300.2 |
| 4,134,494 | A * | 1/1979 | Wong | 206/216 |
| 4,273,272 | A * | 6/1981 | Blanc | 222/464.4 |
| 4,353,765 | A * | 10/1982 | Covi et al. | 156/212 |
| 4,425,769 | A * | 1/1984 | Hakoune | 63/32 |
| 4,733,785 | A * | 3/1988 | Turner et al. | 215/229 |
| 4,940,152 | A * | 7/1990 | Lin | 215/11.5 |
| 5,150,815 | A * | 9/1992 | Saklad | 220/708 |
| 5,195,664 | A * | 3/1993 | Rhea | 222/464.4 |
| 5,518,151 | A * | 5/1996 | Knickerbocker | 222/382 |
| 5,853,852 | A * | 12/1998 | Eichhorn | 428/167 |
| 5,873,474 | A * | 2/1999 | Gray | 215/11.1 |
| 5,934,519 | A * | 8/1999 | Kim et al. | 222/464.4 |
| 6,006,958 | A * | 12/1999 | Bitton | 222/464.1 |
| 6,170,711 | B1 * | 1/2001 | Sherman et al. | 222/192 |
| 6,276,566 | B1 * | 8/2001 | Zaksenberg | 222/78 |
| 6,450,402 | B1 * | 9/2002 | Regev | 235/375 |
| 6,513,682 | B1 * | 2/2003 | Cohen et al. | 222/385 |
| 6,729,500 | B1 * | 5/2004 | Dobbs et al. | 222/78 |
| D492,197 | S * | 6/2004 | Pearson et al. | D9/451 |
| 7,384,006 | B2 * | 6/2008 | Hornsby et al. | 239/333 |
| 7,690,531 | B2 * | 4/2010 | VanGordon et al. | 222/78 |
| 8,235,308 | B2 * | 8/2012 | Gaines et al. | 239/44 |
| 2002/0070244 | A1 * | 6/2002 | Simard | 222/382 |
| 2003/0126887 | A1 * | 7/2003 | Conway | 63/1.18 |
| 2004/0217126 | A1 * | 11/2004 | Lee | 222/78 |
| 2005/0133544 | A1 * | 6/2005 | Tadlock et al. | 222/464.2 |

(Continued)

*Primary Examiner* — Paul R Durand
*Assistant Examiner* — Randall Gruby

(57) ABSTRACT

An ornamental dispersion assembly that provides at least one ornamental portion positioned inside a dispersion assembly for engaging with a liquid or vapor that disperses from the dispersion assembly. The ornamental portion includes spherical gemstones configured to enhance the liquid by providing a smoothing and balancing effect to the liquid. The gemstones include etched surfaces for removing residue from the gemstone and providing a smooth surface to engage the liquid. The gemstones also include an aperture for enabling a siphon inside the dispersion assembly to pass through. In this manner, the gemstone positions on a nonlinear portion of the siphon, and in proximity to a central longitudinal axis of the dispersion assembly to inhibit contact with a sidewall of the dispersion assembly. The transparent dispersion assembly displays the gemstones. As the liquid passes over the gemstone, the liquid is enhanced by becoming more smooth and balanced.

12 Claims, 2 Drawing Sheets

(56) References Cited

U.S. PATENT DOCUMENTS

| | | | | |
|---|---|---|---|---|
| 2005/0269352 | A1* | 12/2005 | Bitton | 222/78 |
| 2006/0147655 | A1* | 7/2006 | Schober | 428/13 |
| 2006/0186144 | A1* | 8/2006 | Tinsley | 222/377 |
| 2006/0237489 | A1* | 10/2006 | De Lataulade | 222/464.1 |
| 2006/0269700 | A1* | 11/2006 | Sater et al. | 428/11 |
| 2008/0264816 | A1* | 10/2008 | Yeh | 206/316.2 |
| 2008/0264976 | A1* | 10/2008 | Boulouard et al. | 222/321.9 |
| 2009/0313744 | A1* | 12/2009 | Hofer | 2/244 |
| 2010/0155418 | A1* | 6/2010 | VanGordon et al. | 222/78 |
| 2011/0186601 | A1* | 8/2011 | Pouliaude et al. | 222/382 |
| 2011/0266248 | A1* | 11/2011 | Popiel | 215/316 |
| 2012/0240622 | A1* | 9/2012 | Sorenson | 63/1.11 |
| 2013/0082070 | A1* | 4/2013 | Feriani et al. | 222/113 |

* cited by examiner

DISPERSION ASSEMBLY

CROSS-REFERENCE TO RELATED OR DEVELOPMENT

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to spray bottles. More particularly, the invention relates to a spray bottle comprising one or more secured ornamental portions.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon. Some people believe that aromatherapy and ornamental portion treatments may cleanse and invigorate their energy and magnetic fields and may create a tingly charging, refreshing, and calming sensation. Some people may like to travel with aromatherapy or body sprays containing ornamental portions in order to perform ornamental portion treatment when away from home.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, an aspect of the prior art generally useful to be aware of is that there are some currently available ornamental portion treated aromatherapy sprays that usually contain essential oils. Some of these sprays may only be ornamental portion "treated" and do not employ the use of real ornamental portions, which may be aesthetically pleasing. Furthermore, it is believed that the effectiveness of these sprays may dissipate over time. In current sprays that do comprise real ornamental portions, the ornamental portions are typically not sturdily mounted to prevent rolling. One may expect that when travelling with such items, the ornamental portions may bump into each other and the container, which may result in damage to the ornamental portions or may reduce the relaxation of the experience.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
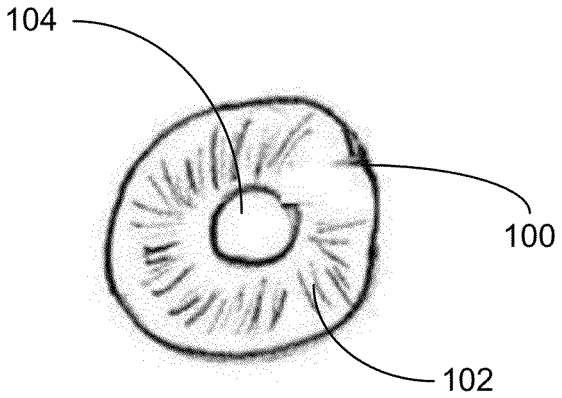
FIG. 1 illustrates a diagrammatic top view of an exemplary ornamental portion for use on a dispersion assembly siphon tube, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

One embodiment of the present invention may include an ornamental dispersion assembly that provides an aesthetic ornamental portion positioned inside a dispersion assembly for engaging with a liquid or vapor that disperses from the dispersion assembly. The ornamental portion may be configured to enhance the liquid or vapor by providing a smoothing and balancing effect to the liquid. The ornamental portion may include a gemstone. Some embodiments may involve the ornamental and purposeful use of natural ornamental portion sphere(s) within an aromatherapy, body-spray, or cologne bottle, etc. made of a transparent material such as, but not limited to, glass or clear plastic. In some embodiments the ornamental portion spheres may be drilled and mounted onto a siphon tube of a spray bottle to secure the ornamental portions from rolling for safe travel and for viewing enjoyment. Some embodiments may also provide for easy retrieval of the ornamental portions for use of the ornamental portions once a user is finished with the product, for example, without limitation, for jewelry or hobby use. Furthermore, some embodiments may yield a ornamental portion saturated, water based liquid catalyst that some people believe may be applied to rejuvenate and energize the magnetic field of the human body.

FIG. 1 illustrates a diagrammatic top view of an exemplary ornamental portion for use on a spray bottle siphon tube, in accordance with an embodiment of the present invention. In the present embodiment, an ornamental portion 100 may position inside a dispersion assembly for engaging with a liquid or vapor that disperses from the dispersion assembly. The ornamental portion may be configured to enhance the liquid or vapor. In some embodiments, the ornamental portion may provide a smoothing and balancing effect to the liquid or vapor. The ornamental portion may include a gemstone. In one embodiment, the liquid or vapor may include, without limitation, purified water, a light blend of essential oils, a body spray, cologne, and a scent. The ornamental portion may include a 10 mm sphere. However, other sizes and dimensions may be utilized. The ornamental portion may include a size and shape that is large enough for viewing yet can still comfortably fit in a standard spray bottle with an atomizer. Some embodiments of the present invention may comprise larger or smaller ornamental portions.

In one embodiment of the present invention, a pure clear quartz based ornamental portion of high quality may be utilized for the ornamental portion sphere. It is contemplated that a multiplicity of suitable ornamental portion and crystal spheres may be used for their aesthetic value and balancing properties in some embodiments such as, but not limited to, cape amethyst, carnelian, beryl, citrine, aquamarine, moonstone, agate, emerald, aventurine, malachite, bloodstone, apatite, sapphire, topaz, sugilite, ruby, mother of pearl, rhodochrosite, opalight, lapis, coral, amethyst, sodalight, fluorite, pearl, tourmaline, jasper, riverstone, onyx, quartzite, diamond, tanzanite, tsavorite, tektite, morganite, spessartite, dumortierite, marble, azurite, chalcedony, jade, spinel, chrysoprase, moldavite, sunstone, turquoise, kyanite, alexandrite, charoite, iolite, hessonite, diopside, sardonyx, seraphinite, obsidian, rhodolite, labradorite, opal, chrysoberyl, prehnite, and heliodor. In some embodiments, the ornamental portions chosen typically comprise unaltered crystal structures that have not been treated with radiation or heat or covered with oils and resins, which some believe may cause the ornamental portions to have a possible disturbing and unbalancing effect. In some embodiments, a spherically shaped gemstone may be chosen to generate a smoothing, balancing, rejuvenation, and energizing effect to the liquid being dispersed from the dispersion assembly. Those skilled in the art, in light of the present teachings, will recognize that some users may have spiritual, religious, or philosophical beliefs that tie in with the spheres. In some alternative embodiments, the ornamental portions may have various different shapes such as, but not limited to, raw crystalline shape, dodecahedron, hexahedron, icosahedron, octahedron, tetrahedron, tube or cylinder, disc, rectangular prism, polyhedron, hexagonal prism, pentagonal prism, octagonal prism, torus, spheroid, cone, triangular prism, hexagonal pyramid, square pyramid, rectangular pyramid, etc.

In one embodiment of the present invention, the at least one ornamental portion may include an etched surface 102. The etched surface may clear the surface of the ornamental portion from any residue or surface treatments. The etched surface may also expose more surface area of the ornamental portion to the liquid into which the ornamental portion sphere is to be submerged. Those skilled in the art will readily recognize, in light of and in accordance with the teachings of the present invention, that various different means may be used to etch the ornamental portion sphere including, without limitation, sandblasting with a material such as, but not limited to, silicon carbide, etching with tools, chemical or acid etching, etc. In the present embodiment, an aperture 104 may be drilled into the ornamental portion sphere. The aperture may be approximately 3.175 mm in diameter so that the ornamental portion may be placed on the siphon of a standard spray bottle. Alternately, the aperture may be made larger or smaller to enable the ornamental portion sphere to be placed on siphons of various different sizes or onto other types of items such as, but not limited to, wire, plastic thread, rods of varying sizes, etc.

Figure 2:
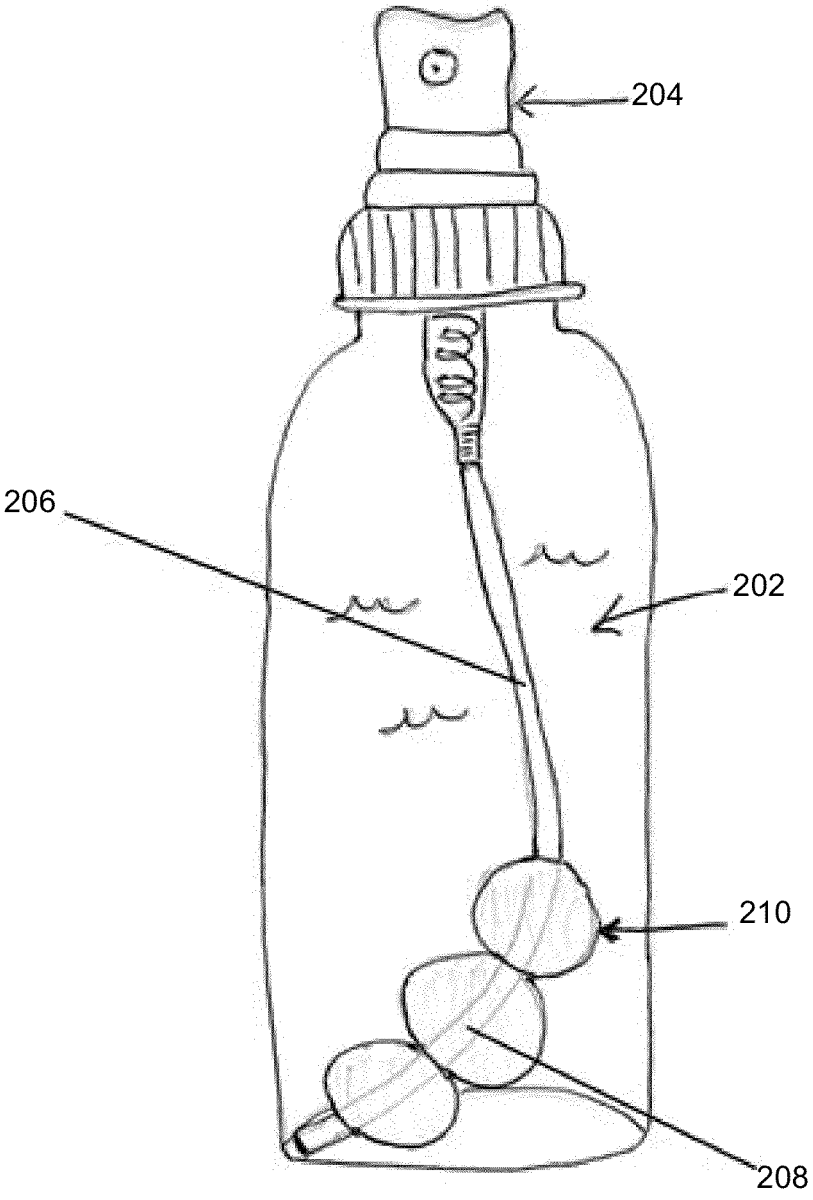
FIG. 2 illustrates a diagrammatic side view of an exemplary dispersion assembly comprising at least one ornamental portion positioned on an exemplary siphon, in accordance with an embodiment of the present invention.

FIG. 2 illustrates a diagrammatic side view of an exemplary spray bottle comprising an exemplary at least one ornamental portion on an exemplary siphon, in accordance with an embodiment of the present invention. In the present invention, a dispersion assembly 202 may contain the liquid or vapor and at least one ornamental portion 210. The dispersion assembly may include a bottle, a container, and a flask. The dispersion assembly may include a standard four ounce glass bottle with an atomizer 204 and a siphon 206. In some embodiments, the at least one ornamental portion 210 may be drilled and placed on the end of the siphon, and then inserted into the dispersion assembly. The siphon may include the right length to create a nonlinear portion 208 near the bottom of the dispersion assembly. In this manner, the at least one ornamental portion may be at least partially prevented from impacting the vertical sides of the dispersion assembly. The end of the siphon may engage the dispersion assembly at an angle on the bottom of the dispersion assembly and flows into the nonlinear portion. The siphon may then angle up towards the center of the dispersion assembly, and finally vertically into the atomizer.

Those skilled in the art, in light of the present teachings will recognize that, when in use with a standard four ounce spray the dispersion assembly, the total length of the siphon may measure about four inches from the end of the siphon to the bottom of the atomizer. It is contemplated that the siphons in some embodiments may have longer or shorter siphons or may have siphons that are straight or that curve into various different shapes. In the present embodiment, at least one ornamental portion may rest upon the bottom of the dispersion assembly. In some embodiments, additional protection for softer gems and/or extreme travel conditions may be employed to generally prevent the ornamental portions from contacting the bottom of the dispersion assembly. For example, without limitation, a small section of tubing made of a material with enough grip to remain in place such as, but not limited to, silicone may be slipped over the siphon tubing holding the ornamental portions above the bottom of the dispersion assembly and generally preventing vertical back and forth motion of the ornamental portions along the siphon. In other embodiments, the ornamental portions may be secured in place on the siphon using various different means including, without limitation, adhesive or clamps, or may not be secured to the siphon.

In typical use of the present embodiment a liquid such as, but not limited to, an aromatherapy or body spray may be poured into the dispersion assembly. Then, the atomizer with an attached siphon and the at least one ornamental portion may be connected to the dispersion assembly so that the ornamental portions may be submerged in the liquid. By mounting ornamental portions on the siphon, the dispersion assembly may provide safe travel and viewing pleasure and additionally may help to blend the liquid in the dispersion assembly. The secure mounting of ornamental portions may generally prevent ornamental portions from rolling around in the dispersion assembly and hitting the sides of the dispersion assembly during travel. The etching on ornamental portions, which increases surface area and may provide more resistance than polished gems, along with the central placement of ornamental portions may help provide easier blending of the contents of the dispersion assembly if the contents need to be shaken before use. Furthermore, the at least one ornamental portion may be surrounded 360 degrees on a horizontal plane and in nearly all planes except where siphon enters and exits ornamental portions and the bottom of the dispersion assembly for the lowest ornamental portion for providing ample mixing surface resistance. For enjoyment and aesthetic value, ornamental portions may be viewed from inside the dispersion assembly. It is believed that gems submersed in liquids are particularly beautiful as they appear magnified and more reflective. Once the liquid inside the dispersion assembly is used or has lost potency, ornamental portions may be safely and easily retrieved and used for various different uses including, without limitation in making bracelets, necklaces, or other decorative items.

In some embodiments, the dispersion assembly with securely mounted ornamental portions may be used to hold and dispense the at least one ornamental portion saturated, water based liquid catalyst. Some users may experience a rejuvenating and energizing feeling when the catalyst is applied. Also, some people may believe that the catalyst may bring balance to the magnetic field of the human body. A catalyst according to one embodiment of the present invention, comprises a base of non-ozonated, purified mineral water. This water may be purified using various different means such as, but not limited to, solar UV treatment, media filtration and/or boiling. Those skilled in the art will readily recognize, in light of and in accordance with the teachings of the present invention, that a multiplicity of suitable liquids may be used for a base in some alternate embodiments including, without limitation, non-mineral water, essential oils, liquid waxes, alcohol's, liquid preservatives, emulsifiers, etc. In the present embodiment, a small amount of one or more essential oils may be added for enjoyment and as a natural preservative. One or more ornamental portions are placed in the catalyst, most likely on the siphon of an atomizer to generally prevent the ornamental portions from bouncing around during travel, which may damage the ornamental portions or the container in which the catalyst is stored. The catalyst is left to stand for a period of time, for example, without limitation, a few hours up to 24 hours. Then, the catalyst may be applied. In some embodiments quartz based ornamental portions may be used for their purported balancing properties, which may enable this catalyst to be applied freely with little concern of creating an unbalancing effect. Some embodiments may use single ornamental portions, multiple ornamental portions of the same type, or a combination of different ornamental portions. For example, without limitation, one embodiment may comprise one cape amethyst sphere surrounded by two clear quartz etched spheres. The use of real ornamental portions in some embodiments may eliminate the dissipation of potency that may occur with currently available gem "treated" sprays, and these embodiments may continue to provide full effects for the life of the catalyst, which may be several months or longer depending on the conditions of the catalyst.

In typical use of some embodiments, this catalyst may be sprayed around the body of a user in attempt to form a cocoon. Then, if desired, a deep breath of the mist may be drawn in and held for at least 12 seconds seconds. The catalyst may be inhaled, yet is typically not suitable for ingestion. The user may stand within this "cloud" of mist for up to three minutes. The treatment is then complete. It is believed that in some cases this catalyst may balance the magnetic field of the human body. In some applications, the catalyst may provide a balancing effect that can be freely applied with little concern of imbalance. For instance, without limitation, a user may just spray the head, just the legs, or just the hands, and the catalyst may be naturally self-balancing and may be able to work no matter where applied. It may be optimal to use this catalyst at room temperature, away from breezes, over natural fibers or skin. Furthermore, electrical equipment typically creates its own magnetic field that may interfere with the treatment and may not be conducive to creating the best environment for success. In some embodiments, this catalyst may be used by various different types of users such as, but not limited to, naturopath doctors, nurses, acupuncturists, massage therapist, veterinarians, athletes, students, meditators, and anyone searching for a more balanced, calming, and energized feeling. Some embodiments may be especially helpful for those within chaotic, stressful and/or noisy environments.

In some embodiments the at least one ornamental portion may be secured along the walls or the bottom of the dispersion assembly using a multiplicity of suitable means such as, but not limited to, glass or plastic mesh. Additionally, in some embodiments, non-degradable line such as, but not limited to, nylon, or plastic fixtures may be used to suspend the ornamental portions. Furthermore, non-degradable line or wire may be used to string the ornamental portions to the siphon. Those skilled in the art will readily recognize, in light of and in accordance with the teachings of the present invention, that some alternate embodiments may comprise a multiplicity of suitable different and/additional features such as, but not limited to, transparent dispersion assemblies of various different colors, various different logos or designs, a fan to help disperse the contents, a handle or carrying strap, an insulated bottle, etc.

Some embodiments may be used for efficient consumer hand blending of a liquid product before use, as the at least one ornamental portion on the siphon may act as a self-contained stirring device with added resistance and abrasion. These embodiments may be used to blend various different types of products including, without limitation, beverages, salad dressings, nail polish, cleaning products, paint, etc. Some embodiments may also be used by a manufacturer of transparent or slightly opaque liquids or gases who would like to suspend 2-D or 3-D models, advertisements, or other objects that do not adversely interact with the solution inside while being securely mounted and protected from rolling and impacting the sides of the dispersion assembly or other type of clear container. Additionally, objects that look better or shinier when wet may benefit being suspended inside securely in this manner in some embodiments. Some embodiments may also provide an interesting way for manufacturers to include prizes or bonus objects inside their visible products to view for enjoyment and for later retrieval. For example, without limitation, a water bottle for sports enthusiasts may comprise a siphon that also has a useable visible item such as, but not limited to, a waterproof compass or watch that may be later retrieved for extended use.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Having fully described at least one embodiment of the present invention, other equivalent or alternative methods of implementing a spray bottle comprising one or more secured ornamental portions according to the present invention will be apparent to those skilled in the art. Various aspects of the invention have been described above by way of illustration, and the specific embodiments disclosed are not intended to limit the invention to the particular forms disclosed. The particular implementation of the spray bottle comprising one or more secured ornamental portions may vary depending upon the particular context or application. By way of example, and not limitation, the spray bottles comprising one or more secured ornamental portions described in the foregoing were principally directed to implementations using Boston round type bottles with atomizers; however, similar techniques may instead be applied to different types of bottles such as, but not limited to, bottles with trigger sprays, pump type bottles, bottles of various different shapes and sizes, perfume and cologne dispensers, jars, vials, dropper bottles, buckets, jugs, packers, pails, drinking bottles with or without straws, squeeze bottles, or seltzer bottles, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

What is claimed is:

1. An assembly comprising:

a dispersion assembly, said dispersion assembly being operable to disperse a liquid;

at least one ornamental portion, aid at least one ornamental portion being disposed to position inside said dispersion assembly, said at least one ornamental portion further being disposed to engage said liquid, said at least one ornamental portion being configured to enhance said liquid;

said dispersion assembly comprises a siphon, said siphon comprises a substantially nonlinear portion, wherein said nonlinear portion is configured to be operable to substantially inhibit said at least one ornamental portion from engaging a sidewall of said dispersion assembly;

said siphon further comprises a small section of tubing having a substantial grip to remain in place being configured to slip over said siphon essentially holding said at least one ornamental portion generally above a bottom of said dispersion assembly and substantially preventing vertical back and forth motion of said at least one ornamental portion along said siphon;

said at least one ornamental portion comprises at least one spherical ornamental portion, said at least one spherical ornamental portion comprise of a spherical gemstone, said at least one spherical gemstone comprises an aperture, said aperture of said at least one spherical gemstone being configured to enable said siphon and small section of tubing to at least partially pass through, in which said siphon being configured to carry said liquid through said dispersion assembly;

said at least one ornamental portion further comprise of at least one quartz based spherical gemstone, wherein said at least one quartz based spherical gemstone further comprise of one selected from the group consisting of cape amethyst, clear quartz, rose quartz, and carnelian, said at least one quartz based spherical gemstone generally surrounded by at least two clear quartz etched spheres.

2. The assembly of claim 1, wherein said dispersion assembly is configured to display said at least one ornamental portion.

3. The assembly of claim 1, wherein said dispersion assembly being configured to be at least partially transparent.

4. The assembly of claim 1, in which said dispersion assembly comprises a spray bottle.

5. The assembly of claim 1, in which said siphon further comprises a tube.

6. The assembly of claim 1, in which said dispersion assembly comprises an atomizer.

7. The assembly of claim 6, in which said atomizer being configured to be operable to disperse said liquid as a vapor.

8. The assembly of claim 1, in which said at least one ornamental portion further comprise of at least one quartz based spherical gemstone.

9. The assembly of claim 8, in which said at least one quartz based spherical gemstone further comprise of one cape amethyst generally surrounded by at least two clear quartz etched spheres.

10. The assembly of claim 1, in which said at least one spherical gemstone comprises an etched surface.

11. The assembly of claim 10, wherein said etched surface being configured to at least partially remove residue from said at least one spherical gemstone.

12. The assembly of claim 1, wherein said at least one ornamental portion being disposed to position in proximity to a central longitudinal axis inside said dispersion assembly.

* * * * *